US009687086B2

(12) United States Patent
Strupp et al.

(10) Patent No.: US 9,687,086 B2
(45) Date of Patent: Jun. 27, 2017

(54) REFRIGERATED SALES FURNITURE

(75) Inventors: Stefan Strupp, Taunusstein (DE); Bernhard Moeller, Trebur (DE); Stefan Ullrich, Kelsterbach (DE); Dimitri Keller, Bischofsheim (DE)

(73) Assignee: CARRIER CORPORATION, Farmington, CT (US)

( * ) Notice: Subject to any disclaimer, the term of this patent is extended or adjusted under 35 U.S.C. 154(b) by 505 days.

(21) Appl. No.: 14/241,917

(22) PCT Filed: Sep. 2, 2011

(86) PCT No.: PCT/EP2011/065195
§ 371 (c)(1),
(2), (4) Date: Feb. 28, 2014

(87) PCT Pub. No.: WO2013/029686
PCT Pub. Date: Mar. 7, 2013

(65) Prior Publication Data

US 2014/0216090 A1 Aug. 7, 2014

(51) Int. Cl.
*A47F 3/04* (2006.01)
*F25D 17/06* (2006.01)

(52) U.S. Cl.
CPC ..... *A47F 3/04* (2013.01); *A47F 3/0443* (2013.01); *A47F 3/0447* (2013.01)

(58) Field of Classification Search
CPC .... A47F 3/0404; A47F 3/0408; A47F 3/0439; A47F 3/0477; A47F 3/046; A47F 3/0452; A47F 3/0491; A47F 3/0443; F25D 17/06
See application file for complete search history.

(56) References Cited

U.S. PATENT DOCUMENTS 3,289,432 A * 12/1966 Brennan ..... A47F 3/0447 62/256
3,392,544 A * 7/1968 Perez ..... A47F 3/0447 62/256

(Continued)

FOREIGN PATENT DOCUMENTS

CH 460066 A 7/1968
DE EP 0628775 A1 * 12/1994 ..... A47F 3/0447

(Continued)

OTHER PUBLICATIONS

International Search Report and Written Opinion; PCT/EP2011/065195; date of mailing May 11, 2012.

*Primary Examiner* — Ryan J Walters
*Assistant Examiner* — Erik Mendoza-Wilkenfe
(74) *Attorney, Agent, or Firm* — Cantor Colburn LLP

(57) ABSTRACT

A refrigerated sales furniture (2) according to the present invention comprises a furniture rear wall (6) extending substantially upright from a base (4); a goods presentation space (10) including a bottom area (12); an air suction channel (20) for sucking air from a lower front end portion of the refrigerated sales furniture (2), the air suction channel (20) having a rear air suction channel portion (26) being arranged at a position behind the bottom area (12) of the goods presentation space (10) and arranged adjacent to and substantially in parallel to the furniture rear wall (4); a fan (30) for conveying air from the air suction channel (20) through an air pressure channel (32), through an evaporator (46), through a cold air channel (48) and through a perforated goods presentation space rear wall (16) to the goods presentation space (10), the fan (30) being arranged between the air suction channel (20) and the air pressure channel (32) at a height corresponding to the height of the bottom area (12) of the goods presentation space (10); the air pressure channel (32) having a lower air pressure channel portion (Continued)

(34) that extends in front of and substantially in parallel to the rear air suction channel portion (26) of the air suction channel (20); the cold air channel (48) having a lower cold air channel portion (54) for conveying cold air through the lower rear wall portion (18) of the perforated goods presentation space rear wall (16) to the bottom area (12) of the goods presentation space (10), the lower rear wall portion (18) of the perforated goods presentation space rear wall (16) being positioned behind the bottom area (12) of the goods presentation space (10), the lower cold air channel portion (54) extending between the lower air pressure channel portion (34) of the air pressure channel (32) and the lower rear wall portion (18) of the perforated goods presentation space rear wall (16).

22 Claims, 1 Drawing Sheet

(56) References Cited

U.S. PATENT DOCUMENTS

| | | | | |
|---|---|---|---|---|
| 4,760,708 | A * | 8/1988 | Karashima | A47F 3/0447 62/255 |
| 5,138,843 | A | 8/1992 | Tamayama et al. | |
| 5,357,767 | A * | 10/1994 | Roberts | A47F 3/0447 454/193 |
| 5,502,979 | A | 4/1996 | Renard | |
| 5,675,983 | A | 10/1997 | Ibrahim | |
| 5,755,108 | A | 5/1998 | Ibrahim et al. | |
| 6,379,240 | B2 | 4/2002 | Livchak et al. | |
| 6,539,741 | B2 | 4/2003 | Navarro | |
| 6,701,735 | B1 | 3/2004 | Daddis, Jr. et al. | |
| 6,742,344 | B2 | 6/2004 | Vormedal | |
| 6,912,864 | B2 * | 7/2005 | Roche | A47F 3/0447 62/256 |
| 7,062,932 | B2 | 6/2006 | Downs | |
| 7,065,977 | B2 | 6/2006 | Upton et al. | |
| 7,121,104 | B2 | 10/2006 | Howington et al. | |
| 7,137,438 | B2 | 11/2006 | Nomura et al. | |
| 7,681,409 | B2 | 3/2010 | Alahyari et al. | |
| 2005/0126196 | A1 | 6/2005 | Grassmuck et al. | |
| 2005/0257548 | A1 * | 11/2005 | Grassmuck | A47F 3/0447 62/246 |
| 2006/0042288 | A1 * | 3/2006 | Downs | A47F 3/0447 62/256 |
| 2009/0044553 | A1 * | 2/2009 | Tilley | A47F 3/0443 62/251 |

FOREIGN PATENT DOCUMENTS

| | | | |
|---|---|---|---|
| DE | 202010008333 | | 11/2010 |
| EP | 0583152 | A1 | 2/1994 |
| EP | 0628775 | A1 | 12/1994 |
| EP | 1741367 | A1 | 1/2007 |
| GB | 2231947 | A | 11/1990 |
| GB | 2269657 | A | 2/1994 |
| JP | 52-001557 | | 1/1977 |
| JP | 52-019354 | | 2/1977 |
| JP | 52-040865 | | 3/1977 |
| JP | 53-063653 | | 6/1978 |
| JP | 53-064863 | | 6/1978 |
| JP | 54-030565 | | 3/1979 |
| JP | 1-208688 | | 8/1989 |
| JP | 1-222183 | | 9/1989 |
| JP | 1-239374 | | 9/1989 |
| JP | 1-285770 | | 11/1989 |
| JP | 6-011236 | | 1/1994 |
| JP | 6-011245 | | 1/1994 |
| JP | 6-018145 | | 1/1994 |
| JP | 6-026753 | | 2/1994 |
| JP | 6-241641 | | 9/1994 |
| WO | 2005074755 | A1 | 8/2005 |

* cited by examiner

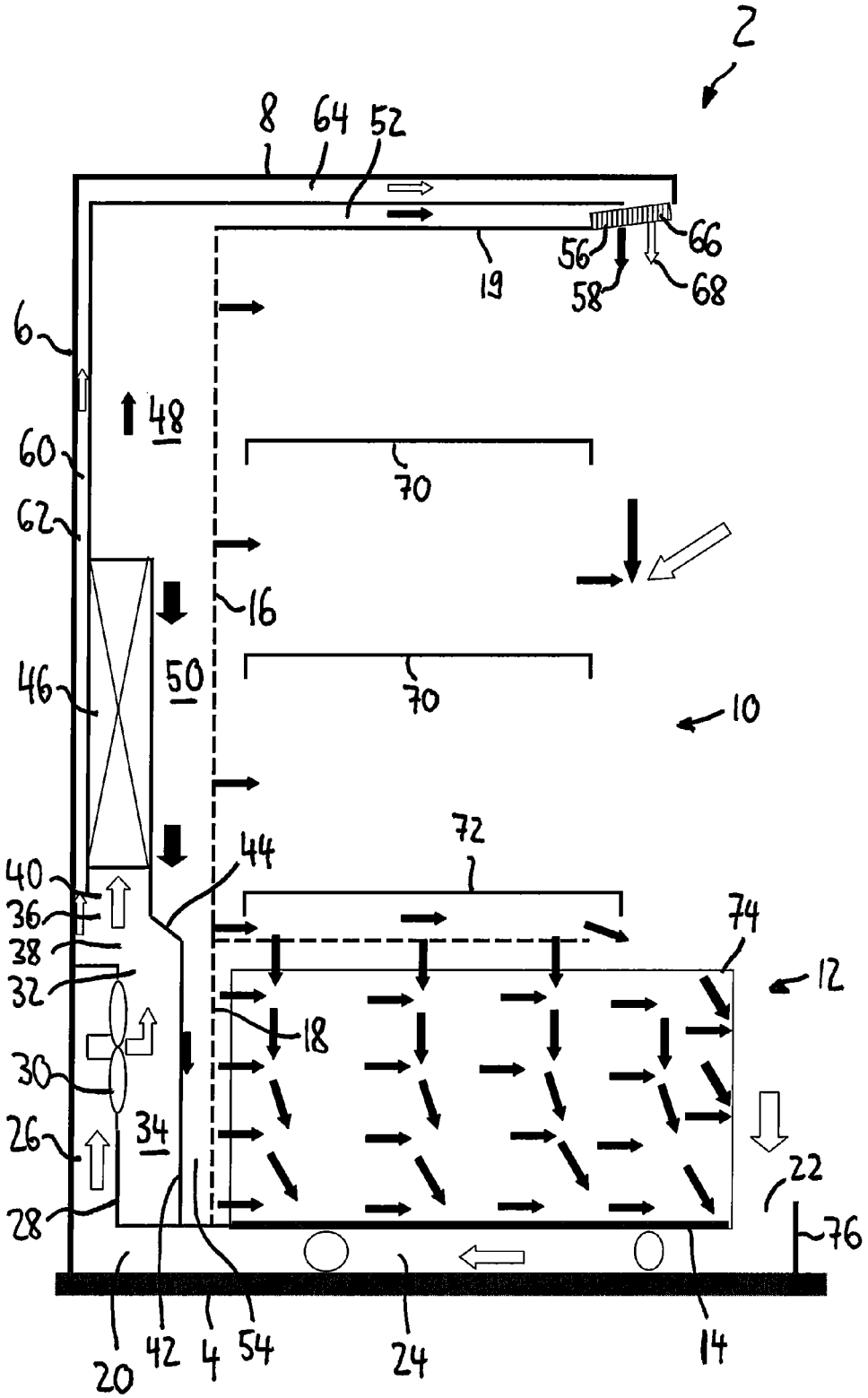
2
8
64
52
66
56
58
68
19
6
48
60
70
62
16
46
50
70
10
72
44
40
36
38
74
32
12
18
30
34
26
22
28
76
20
42
4
54
24
14

REFRIGERATED SALES FURNITURE

The invention relates to a refrigerated sales furniture.

Refrigerated sales furnitures of the front access type allowing for horizontal front access to the goods over almost their entire height are known in the state of the art.

One such front access type refrigerated sales furniture is known from the GB 2 231 947 A, which however has the drawback, that no goods to be presented and sold can be placed in the bottom portion thereof, since according to the embodiment of FIG. 2 the fan 40 and the evaporator 60 are arranged underneath the lowest goods presentation shelf. This limits the available space for presenting goods to be sold which is a drawback, since there is a demand for maximizing the available space for presenting goods to be sold.

With many refrigerated sales furnitures of the front access type it is a problem that the bottom areas thereof cannot be cooled as efficiently as it is the case with the goods presentation shelves and the middle and upper portion thereof.

Accordingly, it would be beneficial to provide a refrigerated sales furniture that maximizes the available space for presenting goods to be sold and provides an efficient cooling in the entire goods presentation space and particularly in the bottom area thereof.

This object is attained by the subject-matter of the independent claim, advantageous embodiments are defined in the sub-claims.

A refrigerated sales furniture according to exemplary embodiments of the invention, as described herein, comprises a furniture rear wall extending substantially upright from a base; a goods presentation space including a bottom area; an air suction channel for sucking air from a lower front end portion of the refrigerated sales furniture, the air suction channel having a rear air suction channel portion being arranged at a position behind the bottom area of the goods presentation space and arranged adjacent to and substantially in parallel to the furniture rear wall; a fan for conveying air from the air suction channel through an air pressure channel, through an evaporator, through a cold air channel and through a perforated goods presentation space rear wall to the goods presentation space, the fan being arranged between the air suction channel and the air pressure channel at a height corresponding to the height of the bottom area of the goods presentation space; the air pressure channel having a lower air pressure channel portion that extends in front of and substantially in parallel to the rear air suction channel portion of the air suction channel; the cold air channel having a lower cold air channel portion for conveying cold air through the lower rear wall portion of the perforated goods presentation space rear wall to the bottom area of the goods presentation space, the lower rear wall portion of the perforated goods presentation space rear wall being positioned behind the bottom area of the goods presentation space, the lower cold air channel portion extending between the lower air pressure channel portion of the air pressure channel and the lower rear wall portion of the perforated goods presentation space rear wall.

Exemplary embodiments of the invention are described in greater detail below with reference to the FIGURE, wherein:

FIG. 1 shows a schematic side view of a refrigerated sales furniture 2 according to an embodiment of the invention, with the side wall/side cover removed in order to give a good view into the goods presentation space 10.

The refrigerated sales furniture 2 is of the front access type and can also be called refrigerated sales cabinet. The refrigerated sales furniture 2 allows for a substantially horizontal access to the goods presented therein by a customer standing in front (in FIG. 1 to the right) of the refrigerated sales furniture 2, over the almost entire height of the refrigerated sales furniture 2. This maximizes the available goods presentation space and meets the retail and wholesale demands.

The refrigerated sales furnitures described herein can be operated at normal cooling temperatures of above 0° C. and at freezing temperatures of below 0° C. In one embodiment, the refrigerated sales furniture can be of the open front access type without front access doors, as described with respect to the attached FIGURE. In particular, the refrigerated sales furnitures described herein can be of such kind and/or can be operated to provide for such cooling temperatures at the evaporator(s) and such air temperatures of the air flowing within the goods presentation space that the lowest temperature commonly achievable for products within the goods presentation space is −1° C.

Although the refrigerated sales furniture 2 of FIG. 1 is open at its front access side it also can be equipped with sliding or pivoting doors at its front access side that have to be opened in order to get access to the goods presentation space.

The refrigerated sales furniture of FIG. 1 comprises a horizontal base 4 that can be provided with stands (not shown), an upright furniture rear wall 6 extending from the rear end of the base 4 that is typically positioned in front of a building wall, and an upper furniture wall 8. The base 4, the furniture rear wall 6 and the upper furniture wall 8 confine together with the side walls (not shown), the interior space of the refrigerated sales furniture 2.

The interior space of the refrigerated sales furniture 2 comprises a goods presentation space 10, which is confined by a goods presentation space bottom wall 14, by a perforated goods presentation space rear wall 16 and by an upper goods presentation space wall 19, as well as air channels 20, 32, 48, 60, a fan 30 and an evaporator 46 that are at least partly located outside of the goods presentation space 10. The air channels 20, 32, 48, 60, the fan 30 and the evaporator 46 are arranged between the furniture rear wall 6 and the perforated goods presentation space rear wall 16, part of an air suction channel 20 is arranged between the base 4 and the goods presentation space bottom wall 14 and substantially horizontal channel portions 52 and 64 of a cold air channel 48 and a warm air channel 60 extend between the upper goods presentation space wall and the upper furniture wall 8.

In the exemplary embodiment of FIG. 1, there are depicted three goods presentation shelves 70, 72 that can be fastened by appropriate means to the perforated goods presentation space rear wall 16 and goods presentation space side walls (not shown), which extend substantially horizontally and carry the goods to be presented and sold.

Although three goods presentation shelves 70, 72 are shown in FIG. 1, any suitable number of goods presentation shelves can be provided within the goods presentation space 10.

The lowermost of the three goods presentation shelves 70 is formed as an air guiding goods presentation shelf 72. Cold air from the cold air channel 48 (to be described later) flows into the interior of such air guiding goods presentation shelf 72 and is directed through appropriate openings at the underside of such shelf 72 in a substantially vertical direction to the goods compartment lying underneath such air guiding goods presentation shelf 72, which is in the embodiment of FIG. 1 the bottom area/base compartment 12. By such air guiding goods presentation shelves, an efficient cooling of the goods positioned in the compartment underneath can be attained.

Between the front end of the goods presentation space bottom wall 14 and the lower front portion of the refrigerated sales furniture 2, that can be provided with a removable bumper 76, there is an air entry opening 22 of an air suction channel 20, into which relatively warm return air enters and is conveyed through a substantially horizontal air suction channel portion 24 arranged between the base 4 and the goods presentation space bottom wall 14 and through a substantially vertical rear air suction channel portion 26 that is arranged at a position behind the bottom area 12 of the goods presentation space 10 and arranged adjacent to and substantially in parallel to the furniture rear wall 6, to a fan 30 that sucks the relatively warm return air through such air suction channel 20 and pushes it through an air pressure channel 32, through an evaporator 46, through a cold air channel 48 and through the perforated goods presentation space rear wall 16 to the goods presentation space 10.

The size of the fan 30 in the figures is only of exemplary kind, also fans of greater height can be used as long as their width is sufficient to fit into the available space between the rear air suction channel portion 26 and the lower air pressure channel portion 34.

The substantially vertical rear air suction channel portion 26 is separated from a lower air pressure channel portion 34 of the air pressure channel 32 by means of a vertical wall 28, and in the present embodiment it ends at a height corresponding substantially to the height of the bottom area 12 of the goods presentation space 10. However, there is no functional relationship between the height of the bottom area and the substantially vertical rear air suction channel portion, and consequently the vertical wall 28 can also end at another position of height. The fan 30 is arranged in an appropriate opening of such vertical wall 28, and it is driven by an electric motor that can be at least partly arranged within the substantially vertical rear air suction channel portion 26.

The air pressure channel 32 comprises a lower air pressure channel portion 34, that extends in front of and substantially in parallel to the rear air suction channel portion 26 of the air suction channel 20, and an upper air pressure channel portion 36 having a greater width than the lower air pressure channel portion 34, the upper air pressure channel portion 36 extending between the furniture rear wall 4 and the cold air channel 48. In other words, in the present embodiment the lower air pressure channel portion 34 extends between the rear air suction channel portion 26 and a lower cold air channel portion 54 of the cold air channel 48 (to be described later) up to a height where the rear air suction channel portion 26 ends, which corresponds to the height of the bottom area 12 of the goods presentation space 10. The rear air suction channel portion 26 is that high that the fan 30 can be accommodated therein with its entire height, and consequently the minimum height of the vertical rear air suction channel portion 26 depends on the height of the fan 30. It is understood, that it is possible to have several fans.

The upper air pressure channel portion 36 extends from the position of height, where the rear air suction channel portion 26 ends, up to a position of height corresponding to the lower end of the evaporator 46, and it is confined on the rear side by the furniture rear wall 6 and on the front side by the cold air channel 48.

The vertical wall 42 that separates the air pressure channel 32 from the cold air channel 48 makes a bend approximately at a middle portion of the height of the upper air pressure channel portion 36, in particular a bent to the back so as to define a reduced width upper section 40 of the upper air pressure channel portion 36 and a higher width lower section 38 of the upper air pressure channel portion 36. At the upper end of the reduced width upper section 40 of the upper air pressure channel portion 36 there is an entry side of a warm air channel 60, in particular a vertical warm air channel portion 62, and an evaporator 46, in particular an entry side of an evaporator 46.

The height and the shape of the vertical wall 42 are described in detail with respect to the non-limiting embodiment of FIG. 1. It is understood that the vertical wall can have another height and another shape as well.

Likewise, the position and the height of the fan 30, of the channel portions 26, 34 and 54, and of the bottom area 12, are described in detail with respect to the non-limiting embodiment of FIG. 1. It is understood that other dimensions are possible, too.

The warm air channel 60 extends from the position of height corresponding to the entry side of the evaporator 46 along the furniture rear wall 6 and the upper furniture wall 8 to a warm air curtain opening 66, which can be a honeycomb, that is positioned at the front of the upper furniture wall 8, and it comprises a substantially vertical cold air channel portion 50 and a horizontal cold air channel portion 52. The partial air flow flowing through the warm air channel 60 is not cooled by the evaporator 46. Such warm air exits the warm air channel 60 through the warm air opening 66 and forms a curtain of warm air 68 in front of the goods presentation space 10 extending between the warm air curtain opening 66 and the air entry opening 22 of the air suction channel 20.

The evaporator 46 is of relatively small width and it is positioned in the intermediate space between the front side of the vertical warm air channel portion 62 and the perforated goods presentation space wall 16 and leaves free enough space in front of the evaporator 46 so as to form a substantially vertical cold air channel portion 50. The evaporator 46 is part of a refrigeration cycle comprising at least a compressor, a condenser, an expansion device, the evaporator 46 and refrigerant conduits connecting these elements serially so as to form a closed refrigeration cycle. The other elements of such refrigeration cycle except for the evaporator 46 are not shown in FIG. 1.

The partial air flow flowing through the evaporator 46 is cooled in the evaporator 46 in heat exchange against a refrigerant circulating in a refrigeration cycle and having been expanded by means of the expansion device before entering the evaporator 46. The air exiting the evaporator 46 from its upper outlet side is called cold discharge air, and it leaves the cold air channel 48 from which it is supplied as cooling air flow to the goods presentation space 10 from the back through the perforated goods presentation space rear wall 16 and as cold air curtain flow to an air curtain opening 56 positioned at the front of the upper furniture wall 8 adjacent to and immediately behind the warm air curtain opening 66 so as to form a curtain of cold air 58 flowing from the cold air curtain opening 56 along the front side of the goods presentation space 10 to the air entry opening 22 of the air suction channel 20. The curtain of cold air 58 is formed behind the curtain of warm air 68, which combination has been shown as particularly effective for minimizing the amount of warm air entering into the goods presentation space 10 from the front.

The cold air channel 48 comprises a substantially vertical cold air channel portion 50 extending over the entire height of the goods presentation space 10, and a horizontal cold air channel portion 52 being positioned underneath the horizontal warm air channel portion 64, the lower wall of which also forms the upper goods presentation space wall.

The substantially vertical cold air channel portion 50 basically has three portions of different widths, namely an upper portion of greater width extending between the upper outlet side of the evaporator 46 and the lower wall of the horizontal warm air channel portion 64, a middle portion of medium-sized width extending between the level of height where the vertical wall 42 makes a bend to the back and level of height corresponding to the upper outlet side of the evaporator 46, and a lower cold air channel portion 54 of smaller width extending between the goods presentation space bottom wall 14 and a level of height where the vertical wall 42 makes a bend to the back.

The width of the upper portion corresponds to the width between the furniture rear wall 6 and the perforated goods presentation space rear wall 16 minus the width of the vertical warm air channel portion 62. The width of the middle portion corresponds to the width between the furniture rear wall 6 and the perforated goods presentation space rear wall 16 minus the width of the evaporator 46 and minus the width of the vertical warm air channel portion 62. The width of the lower cold air channel portion 54 corresponds to the width between the furniture rear wall 6 and the perforated goods presentation space rear wall 16 minus the width of the substantially vertically rear air suction channel portion 26 and minus the width of the lower air pressure channel portion 34.

By the substantially vertical cold air channel portion 50, cold air can be supplied from the back through the perforated goods presentation space rear wall 16 to the goods presentation space 10 over the entire height of the goods presentation space 10, which provides for an efficient cooling of the entire goods presentation space 10, in particular also of the bottom area 12 thereof which could not be attained in conventional refrigerated sales furnitures.

As can be seen in FIG. 1, a trough or a removable container 74 supporting goods to be presented and to be sold is inserted into the bottom area 12, and the airflow in the bottom area 12 is visualized by means of arrows. The cold air flow flowing into the bottom area 12 through the lower cold air channel portion 54 and the lower rear wall portion 18 of the perforated goods presentation space rear wall 16 is depicted by means of horizontal arrows, and it can well be seen that such horizontal airflow extends substantially uniformly over the entire height of the bottom area 12 of the goods presentation space 10.

Likewise such horizontal cold airflow is also present in the goods compartments in the middle and the upper portions of the goods presentation space 10, in particular in the goods compartments over the three goods presentation shelves 70, 72 shown.

Furthermore, by means of the air guiding goods presentation shelf 72 arranged above the bottom area/base compartment 12, cold air from the cold air channel 48, particularly from the substantially vertical cold air channel portion 50, entering the air guiding goods presentation shelf 72 and exiting the same through openings in its bottom enters from above in a downward direction into the bottom area/base compartment 12. This substantially vertical airflow in downward direction is schematically depicted by vertical arrows, and it can be seen that by the combination of cold air entering from behind in a horizontal direction and cold air entering from above in a substantially downward direction, a very efficient matrix cooling can be attained.

The airflow flowing down from the air guiding goods presentation shelf 72 is diverted on its way to the goods presentation space bottom wall 14 in a forward direction by means of the horizontal airflow coming from the back, and so the horizontal and the downwardly directed vertical airflows mix. After having flown through the bottom area/base compartment 12, the air has warmed up in heat exchange against the goods to be sold positioned in the bottom area/base compartment 12 and such airflow enters the air entry opening 22 together with the airflows coming from above, in particular the cold air and warm air curtains 58 and 68.

As a matter of course, also the other goods presentation shelves 70 can be formed as air guiding goods presentation shelves so as to enable an airflow from above in a downward direction to the goods compartment respectively arranged underneath the air guiding goods presentation shelf.

At the front side of the goods presentation space 10, the curtain of cold air 58, the cold air flow coming from the back and the warm air flow coming from the front are depicted schematically by arrows.

A refrigerated sales furniture according to exemplary embodiments of the invention, as described herein, provides for a maximized goods presentation space extending from a very low level of height to a very high level of height within the refrigerated sales furniture, while at the same time an efficient cooling of the entire goods presentation space and in particular of the critical bottom area/base compartment is ensured.

The inventors have discovered that it is advantageous that the fan which is typically quite space-consuming is arranged behind the bottom area of the refrigerated sales furniture. This provides for a refrigerated sales furniture where the entire height can be used for presenting goods to be sold, which meets the demand for a maximized available space for presenting goods to be sold. With the configuration of the exemplary embodiments as described herein, a horizontal cold air flow can be led into the bottom area/base compartment from the back, which ensures an efficient cooling of the entire goods presentation space and in particular of the critical bottom area/base compartment.

The inventors have further discovered that the space available behind the lower rear wall portion of the perforated goods presentation space rear wall can be sufficient for arranging the rear air suction channel portion of the air suction channel, the lower air pressure channel portion of the air pressure channel and the lower cold air channel portion of the cold air channel behind it provided that the width of these channel portions are optimized.

In order to integrate such lower cold air channel portion, the construction depth of the fan area has been optimized and reduced, and the perforated goods presentation space rear wall has been provided with a perforated lower rear wall portion thereof forming the backside of the bottom area/base compartment.

This new backside gets cooled by cold discharge air over the entire height of the base compartment/bottom area and, additionally, the bottom of the base compartment/bottom area gets in contact with cold discharge air too. In conventional refrigerated sales furnitures, the backside of the bottom area of the goods presentation space often came into contact with warmer return air leading to a poor energy efficiency at this point which is reliably avoided according to the refrigeration sales furniture according to exemplary embodiments as described herein, where not only cold air enters the bottom area/base compartment from the back, but also the lower rear wall portion of the perforated goods presentation space rear wall is cold.

Especially in combination with the air guiding goods presentation shelf arranged directly above the bottom area/base compartment, a stable and consistent matrix airflow through the bottom area/base compartment can be provided.

In a refrigerated sales furniture according to exemplary embodiments of the invention lower temperatures of goods stored within the base compartment of the refrigerated sales cabinet can be reached, in particular those lower temperatures correspond to the discharge air temperature.

Further the amount of circulating air can be reduced, since the base compartment gets flown through by cold air directly.

The energy consumption of the refrigerated sales furniture can be reduced because of the advantages as described herein. Moreover, a better temperature performance can be attained, because the air curtain within the base compartment is made more stable even when goods are partly sold.

If the term "the fan" or "a fan" is mentioned within this description and within this claims, this term should be construed to also comprise more than one fan and particularly any appropriate number of fans.

According to an embodiment, the fan is arranged in an opening of a vertical wall separating the rear air suction channel portion of the air suction channel from the lower air pressure channel portion of the air pressure channel. By such arrangement of the fan the available space can be used in a very efficient manner.

According to a further embodiment, the fan is configured to rotate around a substantially horizontal axis. Such fan sucks the air very efficiently from the air entry opening at the front portion of the bottom area and blows the air efficiently through the channels and the evaporator and the perforated goods presentation space rear wall located downstream thereof into the goods presentation space.

According to a further embodiment, the air suction channel has an air entry opening at a front portion of the bottom area, and a substantially horizontal air suction channel portion extending between the base of the refrigerated sales furniture and a goods presentation space bottom wall. By such air suction channel the warm return air can effectively be drawn off from the goods presentation space.

According to a further embodiment, the rear air suction channel portion ends at a height corresponding substantially to the height of the bottom area of the goods presentation space. By such air suction channel portion of optimized height a compact arrangement can be ensured.

According to a further embodiment, the air pressure channel has an upper air pressure channel portion of greater width than the lower air pressure channel portion, the upper air pressure channel portion extending between the furniture rear wall and the cold air channel. By such air suction channel, the air can be blown effectively back into the goods presentation space.

According to a further embodiment, the wall separating the upper air pressure channel portion from the cold air channel makes a bend so as to define a reduced width upper section of the upper air pressure channel portion. By such reduced width upper section of the upper air pressure channel portion the occupied space in the middle rear portion of the refrigerated sales furniture is minimized and the channel width of the cold air channel is maximized.

According to a further embodiment, the cold air channel comprises a substantially vertical cold air channel portion and a horizontal cold air channel portion for conveying cold air to the front side of the top portion of the refrigerated sales furniture. By such cold air channel portions the cold air can effectively be fed to the goods presentation space through the perforated goods presentation space rear wall from behind and at the same time a curtain of cold air can be formed.

According to a further embodiment, at the front side of the top portion of the refrigerated sales furniture there is an air curtain opening of the cold air channel for providing a curtain of cold air in front of the goods presentation space that extends between the air curtain opening and the air entry opening of the air suction channel. By such cold air channel the amount of warm air entering into the goods presentation space from the front can be minimized which provides for a highly efficient cooling.

According to a further embodiment, goods presentation shelves are arranged in the goods presentation space, wherein at least one of the goods presentation shelves is an air guiding goods presentation shelf directing cold air from the cold air channel through its bottom to the compartment of the goods presentation space arranged directly below the goods presentation shelf. By such air guiding goods presentation shelf the goods compartment underneath such shelf can be effectively cooled by means of cold airflows coming from above.

According to a further embodiment, the goods presentation shelf arranged on top of the bottom area of the goods presentation space is an air guiding goods presentation shelf for directing cold air from the cold air channel through its bottom to the bottom area of the goods presentation space. Particularly this portion which is conventionally very difficult to cool, can be cooled reliably by forming the goods presentation shelf arranged above it as air guiding goods presentation shelf.

According to a further embodiment, by conveying cold air through the lower rear wall portion of the perforated goods presentation space rear wall to the bottom area of the goods presentation space and by directing cold air from the cold air channel through the bottom of the air guiding goods presentation shelf to the bottom area of the goods presentation space, a stable and consistent matrix air flow through the bottom area of the goods presentation space is ensured.

According to a further embodiment, a warm air channel is fluidly connected to the air pressure channel. By such warm air channel a partial airflow which is used to form a curtain of warm air along the front side of the goods presentation space is branched off from the air pressure channel.

According to a further embodiment, the warm air channel comprises a vertical warm air channel portion extending basically parallel to the furniture rear wall and a horizontal warm air channel portion extending basically parallel to an upper furniture wall of the goods presentation space.

According to a further embodiment, the vertical warm air channel portion extends between the furniture rear wall and the vertical cold air channel portion, and wherein the horizontal warm air channel portion extends between the upper furniture wall and the horizontal cold air channel portion.

According to a further embodiment, the horizontal warm air channel portion comprises a warm air curtain opening at the front of the upper furniture wall for providing a curtain of warm air in front of the goods presentation space, that extends between the warm air curtain opening and the air entry opening of the air suction channel.

According to a further embodiment, the warm air curtain opening is arranged in front of the cold air curtain opening so that the curtain of warm air will be positioned before the curtain of cold air. By positioning the curtain of cold air behind the curtain of warm air, a further improved efficiency of the refrigerated sales furniture can be attained.

According to a further embodiment, the bottom area of the goods presentation space is formed as a trough, is configured to accommodate or is equipped with a removable container. By such trough or removable container the goods to be presented and cooled can be supported and presented well.

According to a further embodiment, the bottom area of the goods presentation space is confined by a bumper at its front side. By such a bumper the front side of the refrigerated sales furniture can be protected against scratches and the like.

According to a further embodiment, the bumper is of reduced width so as to provide for a sufficient width of the bottom area of the goods presentation space with the rear air suction channel portion of the air suction channel, the lower air pressure channel portion of the air pressure channel and the lower cold air channel portion of the cold air channel being arranged behind the lower rear wall portion of the perforated goods presentation space rear wall. By such reduced width bumper the available goods presentation space can be maximized.

According to a further embodiment, the bumper is removable.

According to a further embodiment, the fan is of reduced width so as to provide for a sufficient width of the bottom area of the goods presentation space. Such a fan has been developed by the inventors. In particular, the vertical rear air suction channel portion can have a width of 30-150 mm, which also limits the width of the fan, such that the fan can have a width of 30-150 mm.

According to a further embodiment, the rear air suction channel portion of the air suction channel, the lower air pressure channel portion of the air pressure channel and the lower cold air channel portion of the cold air channel are of reduced width so as to provide for a sufficient width of the bottom area of the goods presentation space. In particular the width of the lower cold air channel portion can be made smaller than the widths of the rear air suction channel portion and the lower air pressure channel portion. In particular, the vertical rear air suction channel portion can have a width of 30-150 mm, the lower air pressure channel portion can have a width of 30-100 mm and the lower cold air channel portion can have a width of 3-50 mm.

While the invention has been described with reference to an exemplary embodiment, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention is not limited to the particular embodiment disclosed, but that the invention will include all embodiments falling within the scope of the appended claims.

LIST OF REFERENCE NUMERALS

2 Refrigerated sales furniture
4 base
6 furniture rear wall
8 upper furniture wall
10 goods presentation space
12 bottom area
14 goods presentation space bottom wall
16 perforated goods presentation space rear wall
18 lower rear wall portion of perforated goods presentation space rear wall
19 upper goods presentation space wall
20 air suction channel
22 air entry opening
24 substantially horizontal air suction channel portion
26 substantially vertical rear air suction channel portion
28 vertical wall
30 fan
32 air pressure channel
34 lower air pressure channel portion
36 upper air pressure channel portion
38 lower section
40 reduced width upper section
42 vertical wall
44 bend
46 evaporator
48 cold air channel
50 substantially vertical cold air channel portion
52 horizontal cold air channel portion
54 lower cold air channel portion
56 air curtain opening of the cold air channel
58 curtain of cold air
60 warm air channel
62 vertical warm air channel portion
64 horizontal warm air channel portion
66 warm air curtain opening
68 curtain of warm air
70 goods presentation shelves
72 air guiding goods presentation shelf
74 trough/removable container
76 bumper

The invention claimed is:

1. Refrigerated sales furniture comprising:

a furniture rear wall extending substantially upright from a base;

a goods presentation space including a bottom area;

an air suction channel for sucking air from a lower front end portion of the refrigerated sales furniture, the air suction channel having a rear air suction channel portion being arranged at a position behind the bottom area of the goods presentation space and arranged adjacent to and substantially in parallel to the furniture rear wall;

a fan for conveying air from the air suction channel through an air pressure channel, through an evaporator, through a cold air channel and through a perforated goods presentation space rear wall to the goods presentation space, the fan being arranged between the air suction channel and the air pressure channel at a height corresponding to the height of the bottom area of the goods presentation space;

the air pressure channel having a lower air pressure channel portion that extends in front of and substantially in parallel to the rear air suction channel portion of the air suction channel;

the cold air channel having a lower cold air channel portion for conveying cold air through the lower rear wall portion of the perforated goods presentation space rear wall to the bottom area of the goods presentation space, the lower rear wall portion of the perforated goods presentation space rear wall being positioned behind the bottom area of the goods presentation space, the lower cold air channel portion extending between the lower air pressure channel portion of the air pressure channel and the lower rear wall portion of the perforated goods presentation space rear wall;

wherein the air pressure channel has an upper air pressure channel portion of greater width than the lower air pressure channel portion, the upper air pressure channel portion extending between the furniture rear wall and the cold air channel; and further comprising a vertical wall separating the upper air pressure channel portion from the cold air channel, the vertical wall making a bend so as to define a reduced width upper section of the upper air pressure channel portion.

2. Refrigerated sales furniture of claim 1, wherein the fan is arranged in an opening of a second vertical wall separating the rear air suction channel portion of the air suction channel from the lower air pressure channel portion of the air pressure channel.

3. Refrigerated sales furniture of claim 1, wherein the fan is configured to rotate around a substantially horizontal axis.

4. Refrigerated sales furniture of claim 1, wherein the air suction channel has an air entry opening at a front portion of the bottom area, and a substantially horizontal air suction channel portion extending between the base of the refrigerated sales furniture and a goods presentation space bottom wall.

5. Refrigerated sales furniture of claim 1, wherein the rear air suction channel portion ends at a height corresponding to the height of the bottom area of the goods presentation space.

6. Refrigerated sales furniture of claim 1, wherein the cold air channel comprises a substantially vertical cold air channel portion and a horizontal cold air channel portion for conveying cold air to the front side of the top portion of the refrigerated sales furniture.

7. Refrigerated sales furniture of claim 6, further comprising a warm air channel fluidly connected to the air pressure channel.

8. Refrigerated sales furniture of claim 7, wherein the warm air channel comprises a vertical warm air channel portion extending basically parallel to the furniture rear wall and a horizontal warm air channel portion extending basically parallel to an upper furniture wall of the goods presentation space.

9. Refrigerated sales furniture of claim 8, wherein the vertical warm air channel portion extends between the furniture rear wall and the substantially vertical cold air channel portion, and wherein the horizontal warm air channel portion extends between the upper furniture wall and the horizontal cold air channel portion.

10. Refrigerated sales furniture of claim 8, wherein the horizontal warm air channel portion comprises a warm air curtain opening at the front of the upper furniture wall for providing a curtain of warm air in front of the goods presentation space, that extends between the warm air curtain opening and the air entry opening of the air suction channel.

11. Refrigerated sales furniture of claim 10, wherein the warm air curtain opening is arranged in front of the cold air curtain opening so that the curtain of warm air will be positioned before the curtain of cold air.

12. Refrigerated sales furniture of claim 1, wherein at the front side of the top portion of the refrigerated sales furniture there is an air curtain opening of the cold air channel for providing a curtain of cold air in front of the goods presentation space that extends between the air curtain opening and the air entry opening of the air suction channel.

13. Refrigerated sales furniture of claim 1, comprising goods presentation shelves arranged in the goods presentation space, wherein at least one of the goods presentation shelves is an air guiding goods presentation shelf directing cold air from the cold air channel through its bottom to the compartment of the goods presentation space arranged directly below the goods presentation shelf.

14. Refrigerated sales furniture claim 13, wherein the goods presentation shelf arranged on top of the bottom area of the goods presentation space is an air guiding goods presentation shelf for directing cold air from the cold air channel through its bottom to the bottom area of the goods presentation space.

15. Refrigerated sales furniture claim 14, wherein by conveying cold air through the lower rear wall portion of the perforated goods presentation space rear wall to the bottom area of the goods presentation space and by directing cold air from the cold air channel through the bottom of the air guiding goods presentation shelf to the bottom area of the goods presentation space, a stable and consistent matrix air flow through the bottom area of the goods presentation space is ensured.

16. Refrigerated sales furniture of claim 1, wherein the bottom area of the goods presentation space is formed as a trough.

17. Refrigerated sales furniture of claim 1, wherein the bottom area of the goods presentation space is configured to accommodate or is equipped with a removable container.

18. Refrigerated sales furniture of claim 1, wherein the bottom area of the goods presentation space is confined by a bumper at its front side.

19. Refrigerated sales furniture of claim 18, wherein the bumper is of reduced width so as to provide for a sufficient width of the bottom area of the goods presentation space with the rear air suction channel portion of the air suction channel, the lower air pressure channel portion of the air pressure channel and the lower cold air channel portion of the cold air channel being arranged behind the lower rear wall portion of the perforated goods presentation space rear wall.

20. Refrigerated sales furniture of claim 18, wherein the bumper is removable.

21. Refrigerated sales furniture of claim 1, wherein the fan is of width so as to provide for a sufficient width of the bottom area of the goods presentation space.

22. Refrigerated sales furniture of claim 1, wherein the rear air suction channel portion of the air suction channel, the lower air pressure channel portion of the air pressure channel and the lower cold air channel portion of the cold air channel are of width so as to provide for a sufficient width of the bottom area of the goods presentation space.

* * * * *